United States Patent [19]

Roberts

[11] 4,112,525

[45] Sep. 12, 1978

[54] DRYING RACK ASSEMBLY FOR BATHING COMPARTMENTS

[76] Inventor: Jack C. Roberts, 413 Virginia Dr., Orlando, Fla. 32803

[21] Appl. No.: 827,477

[22] Filed: Aug. 25, 1977

[51] Int. Cl.[2] ..... A47K 3/14

[52] U.S. Cl. ..... 4/154; 4/149; 211/96

[58] Field of Search ..... 4/154, 149, 146, 145; 211/94, 96

[56] References Cited

U.S. PATENT DOCUMENTS

| | | | |
|---|---|---|---|
| 2,695,105 | 11/1954 | Mitchell | 211/94 |
| 2,761,150 | 9/1956 | Kellogg | 4/149 |
| 3,021,576 | 2/1962 | Conroy | 4/149 |
| 3,374,899 | 3/1968 | Bator | 211/96 |
| 3,422,464 | 1/1969 | O'Brien | 4/154 |

*Primary Examiner*—Steven L. Stephan
*Assistant Examiner*—L. Footland
*Attorney, Agent, or Firm*—Duckworth, Hobby, Allen & Pettis

[57] ABSTRACT

A shower door or enclosure for a shower stall, bathtub or the like comprises an extrusion frame rigidly positioned between opposing walls of the bathing compartment. A foldable door is suspended from the extrusion and is adapted to be drawn between the opposing walls. At least one drying arm is carried in a top track of the frame and is attached thereto by a pivot which allows the arm to be moved toward and away from the frame and into the bathing compartment, whereby wet garments and the like may be hung upon the arm for drying.

10 Claims, 4 Drawing Figures

DRYING RACK ASSEMBLY FOR BATHING COMPARTMENTS

BACKGROUND OF THE INVENTION

1. Field of the Invention

The present invention relates generally to enclosures and shower doors for bathing compartments such as showers, bathtubs, and the like, and in particular, to apparatus employed in combination with the enclosure in order to allow wet garments to be dried within the bathing compartment.

2. Description of the Prior Art

A "clothes line" is a conventional structure used in conjunction with a residential dwelling, in order to allow wet garments to be dried in the open air. There have also been arrangements wherein clothes lines may be strung indoors, for similar purposes. Likewise, various folding structures have been devised which allow garments to be dried within a building.

In a typical residential bathroom, there are usually several racks mounted on the walls or against the shower door in order to allow wet towels and other wet materials to be hung for drying.

In the prior art, there are numerous structures which are used in conjunction with the bathing compartment for various purposes. In U.S. Pat. No. 3,995,330, there is disclosed a shelf unit in which the shelf is incorporated in the facia panel which holds the shower rod. Other patents of interest include U.S. Pat. Nos. 3,982,284; 3,021,576; 2,594,049; and 2,197,385.

SUMMARY OF THE INVENTION

The present invention contemplates an enclosure for a bathing compartment such as a shower, bathtub, or the like, comprising frame means adapted to be rigidly positioned between opposing walls of the bathing compartment, a foldable closure member suspended from the frame means and adapted to be drawn between the opposing walls of the compartment, and at least one drying arm carried by the frame means. Further means are provided for pivoting the arm toward and away from the frame means and into the bathing compartment, whereby wet garments and the like may be hung upon the arm for drying.

In a preferred embodiment of the present invention, the frame means comprises an extrusion formed from a facia wall normal to and overlapping a partition, the partition extending in a generally horizontal plane while the facia wall extends vertically. The facia wall is oriented outward with respect to the partition to serve as a facia panel for the extrusion. The extrusion is further provided with opposing end walls, each substantially parallel with the partition and normal to the facia wall, with a first one of the end walls defining an upper portion of the extrusion with the partition. The second end wall and the partition likewise define a lower portion of the extrusion. A retainer wall is provided with the extrusion, this wall substantially parallel with the facia wall and normal to the first end wall, the retainer wall spaced from the partition a distance sufficient to receive the arm, thereby allowing the arm to be swung into position within the extrusion. This arrangement reduces the amount of residual moisture within the upper portion of the extrusion during normal operation of the bathing compartment.

THE DRAWING

DETAILED DESCRIPTION

Figure 1:
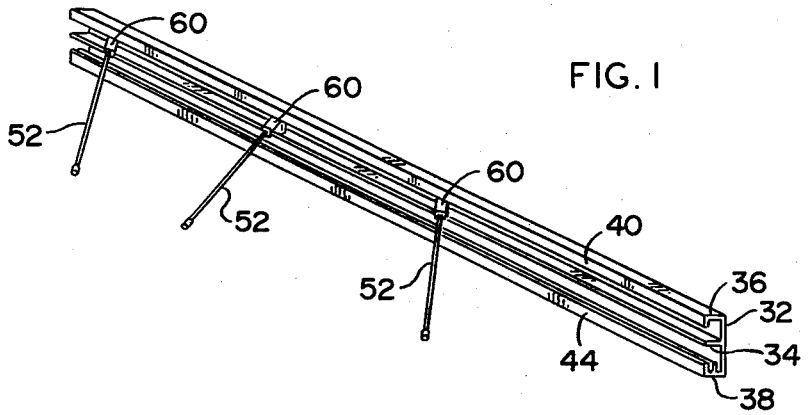
FIG. 1 is a prospective view, partially cut away, illustrating a portion of the drying rack assembly in accordance with the present invention.
Figure 2:
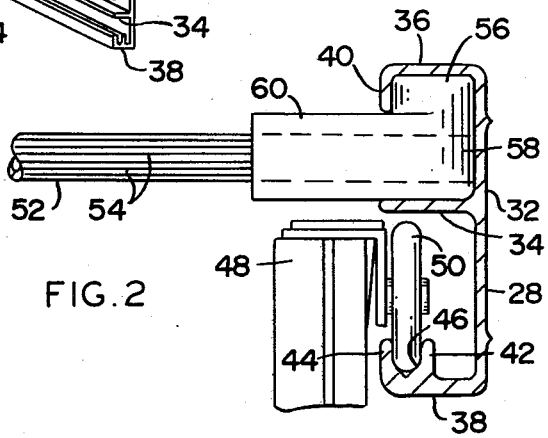
FIG. 2 is a cross sectional view of a portion of the apparatus shown in FIG. 1.
Figure 4:
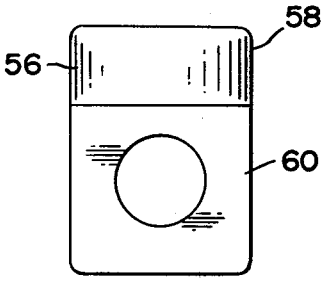
FIG. 4 is an end view of the pivot member.

A preferred embodiment of the drying rack assembly in accordance with the present invention will now be described with reference to FIGS. 1, 2 and 3.

The drying rack assembly, referred to generally as 10, is adapted to be mounted between opposing walls of a shower or similar bathing compartment. The assembly includes two plastic wall jams 16, 18 which are each respectively fixed to one of the shower walls by a sealant, fastener or similar means. Each plastic wall jam 16, 18 is substantially U-shaped and is dimensioned to receive a respective one of a pair of snap-on metal wall jams, described in greater detail below.

The assembly 10 further includes two snap-on metal wall jams 20, 22 each having a substantially U-shaped cross-section and dimensioned so as to fit about the outside of the respective one of the plastic wall jams 16, 18. Each of the snap-on wall jams 20, 22 includes slots 24, 26 on the respective ends thereof.

The drying rack assembly 10 is further provided with upper and lower extrusions 28, 30. The upper extrusion 28 is formed of a facia wall 32 which faces outward from the bathing compartment defined by the shower walls. The extrusion 28 is further provided with a partition 34 which extends normal to the facia wall 32, and generally in the middle thereof. As is clearly shown in FIGS. 1, 2 and 3, the facia wall 32 extends in a generally vertical direction, which the partition 34 is substantially horizontal.

The upper extrusion 28 further includes end walls 36, 38 each of which is substantially parallel with the partition 34 and normal to the facia wall 32, each end wall 36, 38 joined with the facia wall 32 at an extremity thereof. It will thus be seen that each end wall 36, 38 and the partition 34 defines a respective one of an upper or lower portion of the extrusion 28.

The extrusion 28 is further provided with upstanding members 40, 42 and 44 extending normal to the respective end walls 36, 38 and substantially parallel with the facia wall 32. The upstanding members 42, 44 define a groove 46 therebetween.

Figure 3:
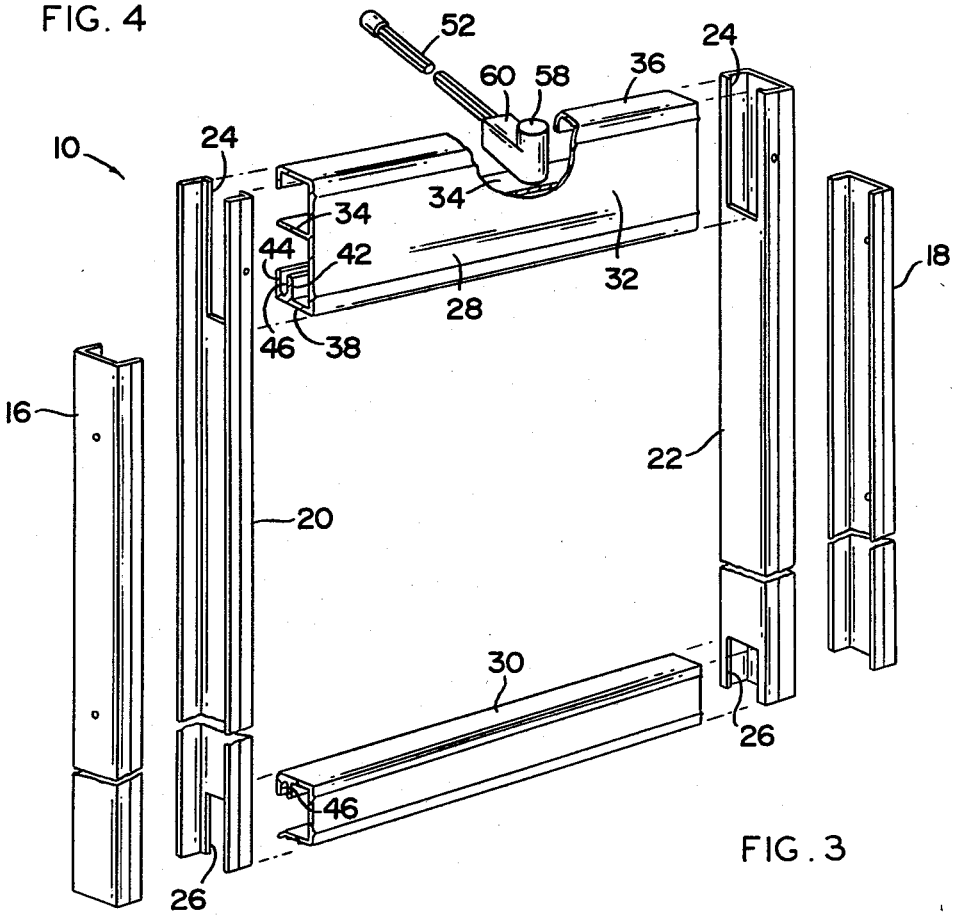
FIG. 3 is an exploded view of the drying rack assembly in accordance with the present invention.

As is specifically shown in FIG. 3, the upper extrusion 28 extends into the slots 24 at the upper end of the jams 20, 22 and is thereafter attached by fasteners (not shown).

The lower extrusion 30 is essentially the same as the lower portion of the upper extrusion 28, but is reversed with respect thereto, such that the groove 46 opens in a downward direction, the opposing grooves 46 adapted to receive wheels associated with a closure, as described next.

A foldable closure 48 is adapted to cooperate with the drying rack assembly 10 as follows. The foldable closure is a contemporary plastic shower door with a panel arrangement, having wheels 50 mounted on the extremities of the hinges thereof. The wheels 50 are adapted to be fitted in the grooves 46, as is shown in FIG. 2. In use, the closure 48 may be moved back and forth in a lateral direction between the shower walls in order to allow access to the bathing compartment.

In accordance with the present invention, the drying rack assembly 10 is provided with a plurality of drying arms 52, each arm having a series of longitudinal ridges 54 along the arm. Each arm 52 is joined to the upper extrusion by a pivot member 56, which is within the upper portion of the upper extrusion 28. The pivot member 56 includes a cylindrical member 58, with the axis of the cylinder extending substantially normal to the partition 34 and likewise normal to the respective arm 52. The pivot member 56 further includes a square block 60 formed integrally with the cylinder 58. The block 60 is dimensioned to fit between the retainer wall 40 and the partition 54. The pivot member 56 may be molded from nylon or similar material. The extrusions 28 and 30 and the snap-on metal jams 20 and 22 may be formed of extruded aluminum.

As can be seen from the drawings, the arms 52 are adapted to be pivoted within the upper portion of the upper extrusion 28, and when rotated outwards, the arms 52 will slide laterally along that extrusion. When in use, the arms 52 may be rotated outward into the bathing compartment, and wet garments or the like may be hung on one or more of the arms to allow the garments to dry. When not in use, the arms 52 may be rotated back within the confines of the upper portion of the upper extrusion 28. It will be noted that the arms 52 are dimensioned that all of the arms fit within the upper portion of the upper extrusion 28.

I claim:

1. A closure for a bathing compartment such as a shower, bathtub or the like, comprising:

an extrusion adapted to be rigidly positioned between opposing closure walls of said bathing compartment, said extrusion including a lengthwise partition dividing said extrusion into two separate and contiguous portions;

a foldable closure member suspended from a first one of said portions of said extrusion and adapted to be drawn between said closure walls;

a drying arm coupled at one end in the second portion of said extrusion; and pivoting and sliding means in said second portion of said extrusion and coupled with said one end of said drying arm for permitting said arm to slide along said extrusion and be folded within said second portion; and further comprising low friction bearing means carried by said extrusion in said lower portion, said bearing means coupled to said closure member whereby said bearing means and said closure member may be moved back and forth across said extrusion; and further comprising a second extrusion spaced below said one extrusion and a second low friction bearing means carried by said second extrusion and coupled to the lower edge of said closure member.

2. The closure recited in claim 1 wherein said extrusion further comprises:

a facia wall normal to, and overlapping said partition, said facia wall oriented outward from said partition to serve as a facia panel for said extrusion;

opposing end walls, each substantially parallel with said partition and normal to said facia wall, a first one of said end walls defining said upper portion to said partition and said second end wall defining said lower portion with said partition;

a retainer wall substantially parallel with said facia wall and normal to said first end wall, said retainer wall spaced from said partition a distance sufficient to receive said arm; and means along said second end wall for supporting said low friction frame means.

3. The closure recited in claim 2 wherein said supporting means comprises two upstanding walls normal to said second end wall, said two upstanding walls defining a groove therebetween for receiving said low friction bearing means.

4. The closure recited in claim 3 further comprising longitudinal ridges along each said arm, said arm coupled to said cylindrical member.

5. A drying rack assembly for bathing compartments such as showers, bathtubs and the like, comprising:

a facia wall adapted to be rigidly positioned between opposing walls of said bathing compartment;

a partition normal to said facia wall and positioned inwardly towards the bathing compartment;

two opposing end walls, each substantially parallel with said partition and normal to said facia wall, both of said end walls defining a slot between said end walls and said partition;

a retaining wall substantially parallel with said facia wall and normal to said first end wall, said retaining wall spaced from said partition a distance sufficient to receive a drying arm;

a foldable closure member;

low friction means mounted across one extremity of said closure member;

means along said second end wall for supporting said friction means;

a plurality of said drying arms; and means for pivotably and slidably mounting each arm within the upper one of said slots.

6. The drying rack assembly recited in claim 5 wherein said pivot and sliding means comprises a plurality of cylindrical members, each cylindrical member fixed on one end of the respective one of said arms, and positioned between one of said end walls and said partition with the axis of each cylindrical member normal to the direction of the corresponding arm.

7. The drying rack assembly recited in claim 6 wherein said means for supporting said low friction bearing comprises two upstanding walls normal to said second end wall, said two upstanding walls defining a groove therebetween for receiving said low friction bearing means.

8. The drying rack assembly recited in claim 7 wherein the total length of all of said rods is substantially equal to the length of said partition.

9. The drying rack assembly recited in claim 7 further comprising:

first and second wall jams, each abutting the respective one of said walls of the compartment;

second and third jams, each meeting with a respective one of said first or second wall jams and each including slots at one end thereof for receiving said extrusion.

10. The drying rack assembly recited in claim 6 further comprising a substantially square member joined to each cylindrical member and extending normal thereto, said square member including a hole therein for receiving said arm, and dimensioned to fit between said partition and said retaining wall.

* * * * *